United States Patent [19]

Miller

[11] Patent Number: 4,457,113

[45] Date of Patent: Jul. 3, 1984

[54] PROTECTED SUPER-ABRASIVE GRINDING TOOL

[75] Inventor: Harold C. Miller, Chicago, Ill.

[73] Assignee: Super-Cut, Inc., Chicago, Ill.

[21] Appl. No.: 351,965

[22] Filed: Feb. 24, 1982

[51] Int. Cl.[3] ..... B24D 5/00

[52] U.S. Cl. ..... 51/206 R; 51/206 NF

[58] Field of Search ..... 51/206 R, 206 NF, 283 E, 51/209 R, 209 DL, 207, 268

[56] References Cited

U.S. PATENT DOCUMENTS

| | | | |
|---|---|---|---|
| 2,766,565 | 10/1956 | Robison | 51/206 R |
| 2,811,960 | 11/1957 | Fessel | 51/206 R |
| 3,271,911 | 9/1966 | McKenna | 51/206 R |
| 3,830,020 | 8/1974 | Gomi | 51/206 R |

FOREIGN PATENT DOCUMENTS

| | | | |
|---|---|---|---|
| 134294 | 11/1978 | Japan | 51/209 R |

*Primary Examiner*—Frederick R. Schmidt
*Assistant Examiner*—Robert A. Rose
*Attorney, Agent, or Firm*—Neuman, Williams, Anderson & Olson

[57] ABSTRACT

This improved rotary-type, super-abrasive grinding tool is designed to cope with a longstanding problem heretofore encountered when subjecting such tools to periodic dressing operations. The improved tool comprises an annular hub having a periphery or rim with a generally U-shaped slot therein, and a generally annularly-configured super-abrasive matrix supported in said slot and having an outer peripheral, configured working surface. The axially opposed walls of the slot buttress and support the sides of the super-abrasive matrix. Each of the walls have a plurality of peripherally-exposed, radially-disposed recesses therein containing a super-abrasive medium, preferably having the same composition and integral with the super-abrasive matrix. The exposed periphery of the super-abrasive medium protects peripherally-aligned portions of the rim from excessive wear when improperly contacted with the dressing medium.

12 Claims, 11 Drawing Figures

PRIOR ART
FIG. 1
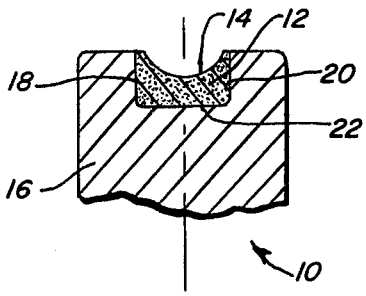
PRIOR ART
FIG. 4
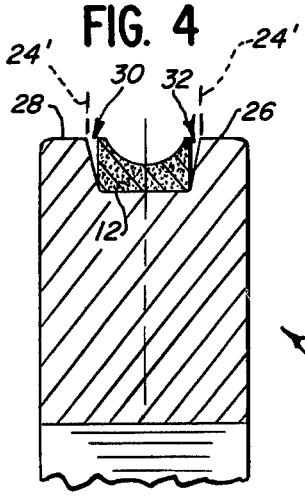
FIG. 6
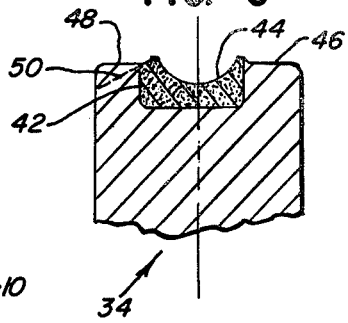
FIG. 2
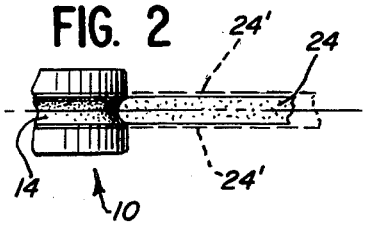
FIG. 3
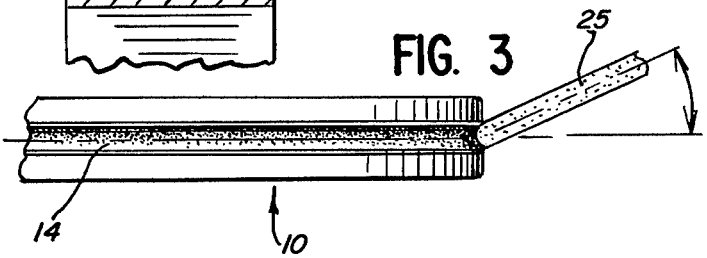
FIG. 5
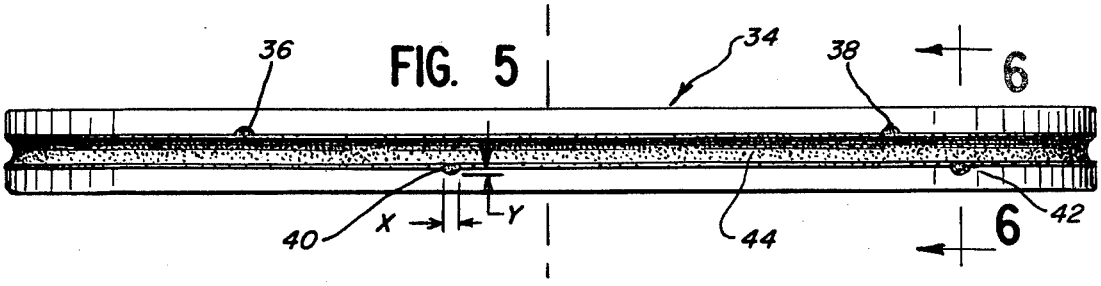
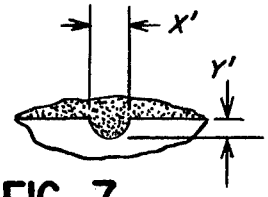
FIG. 7
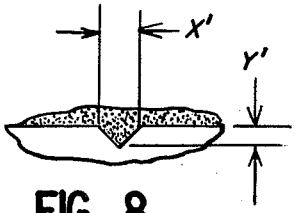
FIG. 8
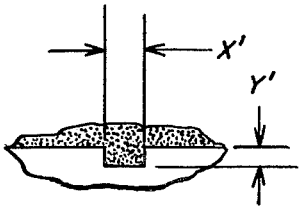
FIG. 9
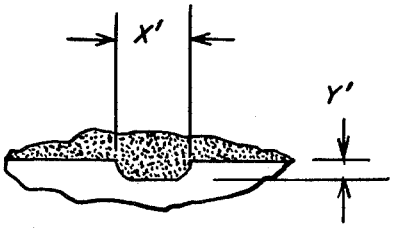
FIG. 10
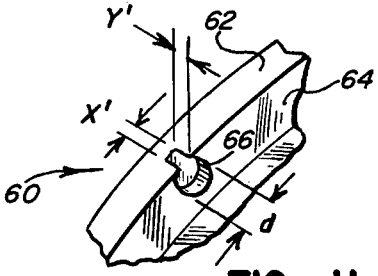
FIG. 11

PROTECTED SUPER-ABRASIVE GRINDING TOOL

BACKGROUND OF THE INVENTION

1. Field of the Invention

This invention relates to rotary-type tools used for material removing operations and particularly to wheels, discs, rings and the like employing a peripherally-disposed, fixed super-abrasive matrix as the material removal medium, such tools typically being employed for grinding, polishing or otherwise working glass, ceramics and the like. More specifically, the invention is directed to an improved design in such tools which effectively and inexpensively copes with a longstanding problem, namely the premature destruction, or undue foreshortening of the useful life of these costly tools caused by the use of faulty or incorrect procedures or implements during periodic dressing of the fixed super-abrasive matrix.

While the present invention will be described with particular reference to several embodiments of what are known in the trade as pencil edging wheels or U-wheels and which are typically used to grind radiused edges in the flat glass and related industries, it should be understood that the invention is not limited thereto. The concepts set forth herein can be readily adapted for use in connection with other material-removing super-abrasive rotary tools, including, but not limited to, seaming wheels and certain types of peripheral wheels, rings, discs and the like, as those skilled in the art will recognize in the light of the present disclosure.

As used herein, the term "super-abrasive" refers to abrasive media suitable for grinding, polishing or similarly working glass, ceramics and the like and having a hardness on the Knoop scale in excess of about 3,000 kg/mm$^2$, preferably substantially in excess thereof. A comparison of Knoop and Mohs hardness values for conversion purposes, if necessary, is available in standard handbooks. Commercially available super-abrasives include natural and synthetic industrial diamonds and cubic boron nitride. For brevity of the description herein, reference will primarily be made to diamond, although, as already indicated, the invention is not limited thereto.

Super-abrasives contrast with "conventional abrasives" of more limited hardness, i.e., a hardness on the Knoop scale of less than about 3,000 kg/mm$^2$. Commercially available conventional abrasives include, for example, garnet, silicon carbide, emery, aluminum oxide, zirconium oxide, cerium oxide, and the like.

The term "fixed", as used herein in connection with either super-abrasives or conventional abrasives, refers to the disposition of the abrasive particles in solid or bonded form, in contrast to being disposed in particulate or powdered form or dispersed in a liquid slurry or similar fluid medium. Thus, in the case of pencil edging wheels the super-abrasive particles are bonded by means of a binder to form an annularly-shaped grinding matrix with a predetermined configured outer periphery, as more fully described hereinafter.

2. Description of the Prior Art

For many years, pencil edging wheels or U-wheels have been used extensively to grind radiused surfaces in flat glass, a particularly extensive application being the grinding of radiused edges on the window glass employed in the modern day automobile. Such pencil edging wheels typically comprise a flat, annular steel body or hub, the periphery or rim of which is radially-inwardly slotted, usually about the center plane, to provide an annular pocket or recess which holds and acts as a support structure for the aforementioned annular fixed super-abrasive grinding matrix. For purposes of high speed edging of automotive window glass, for example, such wheels are typically mounted in Sun rotary edge grinders, a product of Glass Machine Specialties, Inc., Toledo, Ohio, and rotate at speeds in the range of about 2000 to 4000 revolutions per minute. Commercially-available, water-containing coolants are usually employed during the grinding step.

The width of the slot in the wheel periphery containing the super-abrasive matrix is usually slightly greater than the edge of the workpiece to be ground. Because of the high cost of the super-abrasive, however, the excess width is normally kept to a minimum, that is, only that amount required for clearance purposes. The depth of the slot is such that it contains sufficient super-abrasive matrix so as to assure long and economic wheel life despite normal peripheral wear and periodic dressings of the matrix which occurs during the grinding operations, as discussed hereinafter. The exposed peripheral surface of the superabrasive is, of course, configured so as to produce the desired radius on the glass edge being ground, e.g., a smoothly-curved surface.

During a typical grinding operation, however, the super-abrasives at the peripheral working surface of the matrix become flattened or dulled whereby cutting rates are reduced and productivity in terms of linear inches ground, or volume of material removed, per unit time falls. Unexposed super-abrasive in the matrix with fresh cutting edges may be exposed for more efficient grinding by employing a relatively-soft bonding material in the matrix, whereby the grinding operation itself results in progressive wearing away of the bond so as to gradually release the flattened or dulled diamond. This approach, however, is difficult to control, may result in shortened wheel life and is not considered economic or otherwise desirable.

Instead, a relatively wear-resistant or hard bond for the super-abrasive is preferably employed to assure long wheel life, and the matrix is periodically "dressed" so as to wear away some of the bond under controlled conditions and thereby remove the dulled diamond and expose the cutting edges of fresh super-abrasive to the workpiece. It is this "dressing" operation, however, which has given rise to the problem which has long plagued the industry and to which the present invention is directed.

In a typical dressing operation, a dressing wheel or stick is applied to the working surface as it spins so as to selectively wear away the bond. Such dressing wheels or sticks typically comprise fixed conventional abrasives capable of attacking the bond but having little effect upon the super-abrasive itself, e.g., aluminum oxide or silicon carbide. The selective removal of the bond adjacent the working surface releases dulled or flattened super-abrasive and exposes the sharp cutting surfaces of fresh super-abrasive to the workpiece.

The dressing wheel or stick must not, however, contact the adjacent rim of the wheel which supports and buttresses the super-abrasive matrix. As compared with the matrix, the rim structure, which is typically steel, is highly wear prone. Thus, if substantial or prolonged contact of the dressing medium and rim takes place, the rim will be rapidly and selectively eroded away, particularly at the interface with the super-abrasive matrix, leaving adjacent edge portions of the super-abrasive matrix exposed and unsupported. This unsupported matrix is prone to cracking, chipping and other undesired breakage under high speed grinding conditions. This not only damages or destroys the very costly grinding wheel but may also damage or destroy the workpiece.

Dressing machines are available which carefully align the dressing medium with the super-abrasive surface to be dressed without risk of contacting the supporting steel. The effort and down time associated with removing the grinding wheel from the grinding machine for dressing purposes, as well as the cost of such dressing machines, often renders such controlled dressing efforts impractical and uneconomical. This is particularly true when the grinding machine operator is paid at a piece rate and wishes to minimize down time and to maximize cutting rates. Thus, the operator typically uses a dressing stick and hand-dresses the rotating grinding wheel in the grinding machine itself. Unfortunately, because of operator carelessness or neglect or limited visual or manual accessibility to the grinding surface to be dressed, the dressing stick is often applied to the pencil edging wheel at an angle, off center, or otherwise canted in such a fashion that it contacts the supporting rim, as well as the super-abrasive matrix. As a result, portions of the supporting rim adjacent the matrix are rapidly worn away, often to the point where the grinding operation must be prematurely halted and the damaged wheel replaced. Similar damage is incurred, even if a dressing stick is correctly aligned, when an operator employs a dressing stick having a thickness greater than the width of the rim slot.

To cope with these problems, efforts have been made to educate operators as to the nature of the problem and to train them to use dressing sticks of correct thickness and to use care in properly aligning the dressing stick with the super-abrasive surface. Such efforts have only been partially successful, particularly in the case of operators of modern edge grinding machines with restricted accessibility to the working surface of the wheel because of limited space, the presence of safety guards and the like.

Another possible solution is to increase the width of the annular slot in the wheel rim and commensurately increase the amount of super-abrasive matrix therein so that even if a dressing stick is misaligned or if a dressing stick of excess thickness is used, contact with the supporting rim structure is avoided or seldom occurs. This solution, however, is not desirable from an economic standpoint because of the very high cost of the extra super-abrasive matrix required to fill such extra wide rim slot.

As a result, the industry has been plagued for many years with the aforementioned problems, and wheel manufacturers are confronted with excessive returns. This leads to demands for credit when apparent wheel life falls far short of what the manufacturer considered good-faith representations.

OBJECTS OF THE INVENTION

It is therefore a general object of the present invention to cope with the aforementioned problems. It is another general object to provide protected super-abrasive grinding wheels of enhanced useful life. It is still another general object to provide improved pencil edging wheels or U-wheels, which are not readily damaged during periodic dressing steps. It is another general object to provide pencil edging wheels which may be dressed without having to remove them from the grinding machine and without having to take special precautions to avoid damaging the wheels or requiring specially trained operators.

It is a specific object to provide a pencil edging wheel wherein the supporting rim structure is protected from excess wear or erosion when inadvertently contacted with an abrasive dressing tool during a dressing operation. It is another specific object to provide an improved pencil edging wheel which will not be damaged or destroyed even when dressed with an oversized dressing tool or carelessly contacted with the dressing tool. It is still another specific object to provide protected pencil edging wheels or U-wheels, wherein the added protection feature does not significantly add to the cost thereof, require substantial changes in manufacturing procedures or necessitate any modifications in the procedures or machines for using the same.

These and other objects will become apparent as a detailed description proceeds.

SUMMARY OF THE INVENTION

These objects are achieved by a simple and inexpensive modification of the conventional pencil edging wheel, which is hardly detectable except in enhanced resistance to damage when dressed. It is herein described in relation to prior art wheels which are characterized by proneness to the aforementioned problems.

The conventional pencil edging wheel of the prior art comprises a generally annularly-configured super-abrasive matrix having a peripheral, configured working surface and a relatively wear-prone, concentrically-disposed support structure therefor with radial marginal portions abutting and supporting marginal portions of the super-abrasive matrix. In the improved structure of the present invention, the support structure has at least one peripherally-exposed recess in the radial marginal portion contiguous with the super-abrasive matrix. This recess has imbedded therein a peripherally-exposed super-abrasive medium, preferably of the same composition as the super-abrasive matrix and integrally formed therewith. The peripherally-exposed super-abrasive medium in the recess protects circumferentially-aligned rim portions from abrasive erosion due to inadvertent contact with a dressing tool.

In a particular embodiment, the support structure comprises a flat annular steel body, which is radially and centrally slotted at the exposed peripheral surface or rim so as to provide support for the super-abrasive matrix contained therein. The flanges or walls thus formed by the sides of the slot reinforce contacting marginal portions of the super-abrasive matrix. In accordance with the present invention, both flanges have at least one peripherally-exposed recess or groove therein, preferably a plurality of equally-spaced recesses therein, which are filled with super-abrasive matrix integral with that constituting the grinding medium of the tool. In a particularly advantageous embodiment, the recesses or grooves are filled in the same manufacturing operation in which the super-abrasive grinding medium is formed in the rim slot.

With the protected structure of the present invention, the inadvertent use of a dressing stick of excess thickness or the improper application of a dressing stick will not result in damage to the rim portions abutting and supporting the super-abrasive matrix. Yet the amount of super-abrasive employed for such protective purposes, that is, the amount in the recesses, is insignificant in quantity, and thus not a significant cost factor. Inasmuch as the protective feature can be readily added as part of the usual manufacturing operation at little added cost and the resulting tool is employed exactly as the prior art unprotected tool and requires no additional operator training (and, in fact, less), a simple, yet highly effective, solution to a longstanding problem and a superior tool are achieved virtually without economic penalty.

BRIEF DESCRIPTION OF THE DRAWINGS

The present invention will be more clearly understood from the following detailed description of specific embodiments, read in conjunction with accompanying drawings, wherein:

FIG. 1 is a section view of an edge portion of an annular pencil edging wheel of the prior art in an unused condition;

FIG. 2 is a reduced scale fragmentary portion of a pencil edging wheel similar to that of FIG. 1 being dressed, the dressing stick being properly applied to the super-abrasive matrix;

FIG. 3 is similar to FIG. 2 except that the dressing stick is being applied improperly at an angle so as to contact the rim structure;

FIG. 4 is a section view of an edge portion on the same scale as FIG. 1 and illustrates the damage done to the supporting rim structure when a dressing stick has been improperly applied, as illustrated in FIG. 3;

FIG. 5 is an edge view on the same scale as FIGS. 2 and 3 and illustrates a protected pencil edging wheel made in accordance with the present invention;

FIG. 6 is a section view, on the same scale as FIG. 1, of a cut-away rim portion on lines 6—6 of FIG. 5;

FIGS. 7, 8, 9 and 10 are enlarged fragmentary views of protected pencil edging wheels illustrating a few of the various configurations of the protective slots which may be employed in the practice of the present invention; and FIG. 11 illustrates still another form of a protective slot which lends itself to manufacturing advantages when used in connection with certain embodiments.

It should be understood that the drawings are not necessarily to scale and that the embodiments are illustrated by graphic symbols, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE DRAWINGS INCLUDING PREFERRED EMBODIMENTS

Pencil edging wheels are well known to those skilled in the art, the fragmentary portions of FIGS. 1 and 2 being illustrative. They are typically flat-sided annular structures with the outside diameter of typical standard sizes ranging from about two inches to eighteen inches. The inside diameter of the annular structure depends primarily upon the requirements of the grinding machine on which it is to be used. In one embodiment, for example, the outer diameter may be about ten inches and the inner diameter may be about seven and one-half inches.

Referring to FIG. 1, pencil edging wheel 10 comprises super-abrasive matrix 12 having a concave configured working surface 14 corresponding to the desired curvature of the workpiece, e.g., the edge of window glass. Super-abrasive matrix 12 is supported in a generally rectangular or U-shaped slot in the outer periphery of annular support structure 16. Side walls 18 and 20 and inner periphery 22 of the slot support the super-abrasive matrix 12.

While the materials of construction per se of the prior art pencil edging wheels are not part of the present invention, they typically comprise a low carbon steel annular support structure and a super-abrasive matrix comprising a minor proportion of super-abrasive particles, e.g., diamonds, and a major proportion of binder or bond for the diamonds. In a specific embodiment, for example, the amount of diamonds may be present in the amount of about five to twenty percent by weight, the remainder of the matrix being the bond material. The bond is typically formed from a metal powder mixture which may consist of some or all of iron, copper, tin, nickel, cobalt, chromium boride, tungsten carbide, titanium, or possibly other ingredients. The constituents, as well as the proportions thereof, may vary, depending in part upon the requirements of the material removal operation and the manufacturers' own individual concepts as to how best to meet such requirements.

Referring to FIG. 2, rotating pencil edging wheel 10 is being dressed by dressing stick 24. Dressing sticks for dressing pencil edging wheels vary in size, commercially available sticks typically being rectilinear when new, e.g., $\frac{1}{4}$ inch$\times\frac{3}{4}$ inch$\times$4 inches and 3/16 inch to $\frac{1}{2}$ inch$\times$2 inches$\times$7 inches. As above indicated, they should have a thickness no greater than the width of a peripheral slot and preferably no greater than needed to dress working surface 14. A dressing stick is properly applied with its center plane coincident with that of working surface 14. Contact of the dressing stick with the supporting steel structure of the rim is thus avoided and the integrity of the slot walls buttressing the super-abrasive matrix is maintained. The rotating super-abrasive rapidly conforms the contacting surface of the stick to its own curved surface, and the dressing action proceeds whereby exposed bond is worn away, dulled diamond is released and fresh diamond is exposed. This assumes, of course, that the dressing stick is of the proper thickness.

If, however, the thickness of the dressing stick is excessive, as suggested by the dash lines 24' in FIGS. 2 and 4, the conventional abrasive of the dressing stick contacts the supporting steel structure of the rim and very rapidly erodes it away, leaving edge surfaces of the super-abrasive matrix unsupported and prone to damage. Similarly, if the abrasive stick is applied at an angle or canted such that it contacts the steel support structure, the same problem is encountered. This is illustrated in FIG. 3 wherein dressing stick 25 is applied at an angle to the surface to be dressed in such a fashion that edge portions of the stick contact the metal rim and rapidly erode it away.

The wear-proneness of the steel support structure to the conventional abrasive, as compared with the wear-resistance of the super-abrasive matrix, is illustrated graphically in FIG. 4. When a dressing stick of excessive thickness, as diagrammatically illustrated by dashed lines 24', is applied to the super-abrasive matrix, the edge portions thereof rapidly erode away peripheral rim portions 26 and 28 adjacent the super-abrasive matrix, leaving gaps 30 and 32. This leaves edge surfaces of super-abrasive matrix 12 unsupported and prone to damage. As hereinabove described, this not only cuts short the useful life of the grinding tool but may also damage the workpiece.

Referring to FIG. 5, when tool 34 is protected by recesses 36, 38, 40, 42, etc., in accordance with the present invention, no substantial damage will occur. Each of the recesses contains a super-abrasive medium having, preferably, the same hardness characteristics of the super-abrasive matrix 44 itself. As above indicated, in a preferred embodiment the super-abrasive medium in the recesses is the same as that of the matrix itself and integrally formed therewith whereby the wear properties are the same. In one method of manufacture this is very readily achieved because the super-abrasive matrix is formed in situ using the supporting wheel structure as part of the mold, as those skilled in the art are aware. Thus, when the super-abrasive particles and bond are added to the slot, the recesses are filled therewith. Both the grinding matrix itself and the protective matrix of the slots are thus formed in situ in the same operation, that is by the application of requisite heat and pressure. Such conditions are known to those skilled in the art and are not, per se, part of the present invention.

Referring to FIG. 6, the super-abrasive medium of recess 42 and super-abrasive matrix 44 are integral and exhibit the same wear characteristics. When a dressing stick of excessive thickness or a dressing stick is improperly applied to the super-abrasive matrix 44 and contacts the supporting metal structure abutting the same, the super-abrasive medium of the recesses chips away or wears away the stick so that very little of the supporting steel structure peripherally aligned with the protective recesses is eroded. Thus, as illustrated in FIG. 6 peripheral rim portions 46 and 48 show minimal erosion, no gaps are formed, and the super-abrasive matrix 44 is still well supported. Even if excessive erosion were to take place axially exterior of the recesses, as illustrated, for example, by dash line 50 in FIG. 6, such erosion is of no concern because the integrity of the steel supporting structure buttressing the super-abrasive matrix is still maintained.

In general, the size of the protective recesses need only be that required to prevent the dressing stick from wearing away the supporting structure under abusive dressing conditions. This is best determined empirically because it depends upon a number of variables, including the number of protective recesses around the periphery, the size and nature of the dressing stick, the peripheral speed of the tool being dressed, the dressing pressures employed, the thickness of the dressing stick, the disposition of the stick relative to the surface being dressed, etc. Thus, for example, the greater the number of protective recesses around the periphery, the smaller the requisite size of the protective recesses.

Subject to such considerations, it is presently believed that the recesses of FIG. 5 should typically have an exposed peripheral length, designated X in FIG. 5, of about 1/16 inch to $\frac{3}{8}$ inch, preferably about 3/32 inch to 5/16 inch, optimally about $\frac{1}{8}$ inch to $\frac{1}{4}$ inch. The number typically may vary from one to about twelve, preferably about two to eight, optimally about three to six. The recesses are preferably equally spaced around the periphery on each side of the grinding matrix. Thus, in the case of four recesses on each side, they are spaced about every 90° apart. The recesses on each side may, but need not, be axially aligned.

The axial depth Y of the recess may be in the range of about 3/64 inch to $\frac{1}{4}$ inch, preferably about 1/16 inch to $\frac{1}{8}$ inch. The radial length of slot should approximate the depth of the super-abrasive matrix, e.g., typically about 1/16 inch to $\frac{1}{4}$ inch, although it may be slightly less because the super-abrasive matrix is not usually worn completely through before the wheel is discarded. Accordingly, the length may be selected depending upon such factors.

Variously-configured recesses may be employed, as illustrated in FIGS. 7, 8, 9 and 10. The semi-circular recess of FIG. 7 approximates that shown in FIG. 5. The triangular-shaped recess of FIG. 8 would take less super-abrasive medium to fill it, but it would not be expected to give the same wear properties at the apex of the triangle as would the semi-circular configuration of the recess of FIG. 7 or the rectilinear configuration of the recess of FIG. 9. Thus, dimension Y' of FIG. 8 may have to be greater than Y' of FIGS. 7 and 9 to get the requisite protective characteristics.

The recesses of FIGS. 8 and 9 also suffer from the presence of sharp corners. These present a minor problem during manufacture because of the difficulty of assuring that the sharp corners are filled completely and compactly with super-abrasive medium when the protective super-abrasive matrices of the protective recesses or slots are integrally formed in situ with the super-abrasive grinding matrix. A configuration compromising such considerations is that shown in FIG. 10, which is somewhat rectilinear with rounder corners or essentially an approximate combination of the configurations of FIGS. 7 and 9 and yet does not have some of the disabilities thereof. Thus, the length X' may be extended without excessively increasing the depth Y' and yet the sharp corners characteristic of FIG. 9 are avoided.

To illustrate the low cost of an erosion-protected pencil edging wheel of the present invention from an added material cost standpoint, the following volumes of the protective recesses in a typical ten-inch protected pencil edging wheel having a $\frac{1}{4}$ inch$\times\frac{1}{4}$ inch slot, such as depicted in FIG. 5, were calculated for the semi-circular embodiment of FIG. 7, assuming X' is $\frac{1}{8}$ inch, Y' is 1/16 inch and the radial depth is $\frac{1}{4}$ inch. The volumes are presented in cubic centimeters and as a proportion or percent of the grinding matrix:

| No. of Recesses on Each Side of Wheel | Vol. of Matrix in Recess, cc | Percent of Total Matrix Volume |
|---|---|---|
| 1 | 0.05 | 0.16 |
| 3 | 0.15 | 0.48 |
| 4 | 0.20 | 0.64 |
| 6 | 0.30 | 0.96 |
| 8 | 0.40 | 1.28 |
| 10 | 0.50 | 1.60 |
| 12 | 0.60 | 1.92 |

Thus, for example, with four protected recesses on each side of the wheel, the total matrix volume, i.e., protective matrix and grinding matrix, is increased by only 0.30 cc or 0.96%—an insignificant cost factor. If the equivalent protection were attempted by increasing the slot width by 1/16 inch on each side, it would increase the grinding matrix volume by approximately 50 percent, a prohibitive cost factor considering the high material cost of the diamond-containing matrix.

When the annular tool is actually made up of two annular sections or half rims whereby the inner slot walls are exposed before they are joined together, a very inexpensive, but effective, protective recess or groove may be formed therein, as illustrated in FIG. 11. This figure diagrammatically depicts annular half rim 60 having rim surface 62 and slot wall 64 before the half rim is joined with its counterpart to form the annular support for the matrix. A generally cylindrical recess 66 is formed therein by milling the recess adjacent the periphery, whereby an edge portion is peripherally exposed, the peripheral length X' being made adequate for the desired protection. When the half rims are joined and the super-abrasive matrix is formed in situ in the resulting slot and recess, the exposed portion of the super-abrasive matrix in the recess provides the desired protection during the dressing operation. Manifestly, as the recesses and adjacent supporting steel structure are worn away during use, the length X' in FIG. 11 will increase with corresponding increase in protection, at least until the midpoint of the recess if reached. The end mill used to mill recess 66 preferably has rounded or curved extremities so that no sharp corners are generated therein.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

Having described the invention, what is claimed is:

1. In a rotary grinding tool comprising a generally annularly-configured super-abrasive matrix having an outer peripheral, configured working surface and a relatively-wear-prone, concentrically-disposed support structure therefor with continuous radial marginal portions laterally abutting and supporting marginal side portions of the super-abrasive matrix continuously around the periphery thereof, the improvement wherein said support structure has at least one peripherally-exposed recess in said continuous radial marginal portions contiguous with said super-abrasive matrix and having imbedded in said recess a peripherally-exposed super-abrasive medium.

2. The grinding tool of claim 1 wherein said super-abrasive medium and said super-abrasive matrix consist of the same composition and are integrally formed.

3. The grinding tools of claims 1 or 2 including a plurality of peripherally-exposed recesses in said radial marginal portions.

4. The grinding tools of claim 1 or 2 wherein said support structure comprises a flat annular hub having a periphery with a generally U-shaped slot therein, the opposed walls of the slot buttressing axial extremities of said super-abrasive matrix, each of said walls having at least one peripherally-exposed recess therein and having imbedded in each recess a peripherally-exposed super-abrasive medium.

5. The grinding tools of claim 1 or 2 wherein said support structure comprises steel.

6. The grinding tools of claim 1 or 2 wherein said super-abrasive matrix and said super-abrasive medium comprise super-abrasive particles imbedded in a bonding medium.

7. The grinding tools of claim 6 wherein said super-abrasive particles are selected from the group consisting of natural diamonds, synthetic diamonds, cubic boron nitride and mixtures thereof.

8. A protected rotary grinding tool comprising:

(a) a generally annularly-configured super-abrasive matrix having an outer peripheral, configured working surface;

(b) a relatively-wear-prone, concentrically-disposed support structure for said super-abrasive matrix with continuous radial marginal portions laterally abutting and supporting marginal side portions of the super-abrasive matrix continuously around the periphery thereof, said support structure having a plurality of peripherally-exposed recesses in said continuous radial margin portions contiguous with said super-abrasive matrix and having imbedded in said recesses a super-abrasive medium having the same composition as said super-abrasive matrix and integrally formed therewith.

9. The protected super-abrasive grinding tool of claim 8 wherein said support structure comprises steel and said super-abrasive matrix and said super-abrasive medium are integral and comprise super-abrasive particles imbedded in a bonding medium.

10. The protected super-abrasive grinding tool of claims 8 or 9 wherein said super-abrasive particles are selected from the group consisting of natural diamonds, synthetic diamonds, cubic boron nitride and mixtures thereof.

11. A protected super-abrasive grinding tool comprising:

(a) an annular relatively-wear-prone hub having a periphery with a generally U-shaped slot with continuous axially-opposed side walls therein;

(b) a generally annularly configured super-abrasive matrix supported in said slot and having an outer peripheral, configured working surface;

(c) the axially opposed side walls of said slot laterally buttressing axial extremities of said super-abrasive matrix continuously around the periphery thereof; and (d) each of said side walls having a plurality of peripherally-exposed recesses therein containing a super-abrasive medium of the same composition and integral with said super-abrasive matrix, the exposed periphery of the super-abrasive medium protecting peripherally aligned portions of said hub.

12. The protected super-abrasive grinding tool of claim 11 wherein said super-abrasive matrix and said super-abrasive medium comprise super-abrasive particles imbedded in a bonding medium, said super-abrasive particles being selected from the group consisting of natural diamonds, synthetic diamonds, cubic boron nitride and mixtures thereof.

* * * * *